United States Patent [19]

Popplewell

[11] 3,993,310

[45] Nov. 23, 1976

[54] SHUTTLECOCKS

[75] Inventor: Frank William Popplewell, Saffron Walden, England

[73] Assignee: Dunlop Limited, London, England

[22] Filed: Mar. 14, 1975

[21] Appl. No.: 558,561

[30] Foreign Application Priority Data

Mar. 22, 1974 United Kingdom ..... 12805/74

[52] U.S. Cl. ..... 273/106 A; D34/5 SH

[51] Int. Cl.[2] ..... A63B 67/18

[58] Field of Search ..... 273/106 A; D34/5 SH

[56] References Cited

UNITED STATES PATENTS

| | | | |
|---|---|---|---|
| 2,860,879 | 11/1958 | Carlton | 273/106 A |
| 3,560,128 | 2/1971 | Carlton | 273/106 A |
| 3,831,943 | 8/1974 | Popplewell | 273/106 A |

*Primary Examiner*—Richard C. Pinkham
*Assistant Examiner*—Marvin Siskind
*Attorney, Agent, or Firm*—Stevens, Davis, Miller & Mosher

[57] ABSTRACT

A shuttlecock skirt has an array of diverging stems, whose ends are at the convergent end of the skirt, joined together in an end-ring. The outer end of the end-ring is closed to form a member of 'U' — shaped transverse cross-section. This member is provided with a nose-stem, projecting away from the skirt, for anchoring a striking cap. In a preferred embodiment a radial extension, e.g. disc, is attached to the nose-stem and various preferred dimensions for the end-ring are defined.

7 Claims, 5 Drawing Figures

SHUTTLECOCKS

This invention relates to shuttlecocks and particularly skirts therefor. Shuttlecocks have basically two portions, one being the cap or striking portion and the other being the skirt portion which provides the flight characteristics. The invention is concerned with skirts moulded, for example by an injection-moulding technique, from a suitable plastics material, and with shuttlecocks incorporating such skirts.

Moulded shuttlecocks skirts are well known. They usually comprise a number of diverging stems or vanes which define a cone-like structure. In the case of a skirt moulded in one piece, the ends of these stems which converge at the convergent end of the skirt i.e. the 'root ends' of the stems are normally joined together to form a continuous ring, referred to as the 'end-ring'.

A number of variations of this basic design have been postulated but a typical, widely-used type of moulded skirt is illustrated in FIG. 1 of the accompanying drawings. This shows a longitudinal section through a conventional moulded shuttlecock without the striking cap.

The present invention is particularly concerned to provide a moulded skirt having improved physical characteristics when the shuttlecock is struck by a racket.

The present invention provides an integrally moulded shuttlecock skirt comprising a plurality of diverging stems which define a substantially frusto-conical structure, and whose ends at the convergent end of the skirt are joined together to form an end-ring, that end of the end-ring remote from the stems being closed to form a member of substantially 'U'-shaped longitudinal cross-section and being provided with a nose stem which extends from the base of the 'U' and away from the skirt to provide anchorage means for a striking cap.

The longitudinal axis of the end-ring will normally be substantially coincident with the longitudinal axis of the skirt.

By means of this invention, a shuttlecock skirt having an end-ring of low radial rigidity can be provided, by virtue of the absence of radially extending components in the end-ring region of the skirt. One disadvantage of using a rigid end-ring is that this results in an abrupt change in stiffness from the ring to the stem, and the skirt is consequently more liable to breakage.

There are two conflicting features to be optimized in the end construction. These are the need for the skirt to be flexible in order to reduce the risk of breakage on impact and the need for the skirt to be stiff so that it will recover quickly from deformation on impact. In skirts of the invention, the end-ring can be made more radially flexible than is conventional without deleteriously affecting the overall recovery properties of the skirt.

The axial length of the end-ring is preferably in the range 2 to 10 mm, e.g. 3 to 8 mm, while its internal diameter can for example be in the range 4 to 12 mm, especially 6 to 9 mm. The wall thickness of the end-ring is preferably from 0.3 to 1 mm.

A further advantage of shuttlecocks according to the invention is that the nose-stem feature results in there being relatively little solid material inside the striking cap of the shuttlecock; the cushioning effect of the cap is thus improved.

Since the nose-end of a shuttlecock is to be enclosed in a striking cap, satisfactory binding means must be used to ensure that the skirt and cap do not part company in use. This may be achieved by any convenient means including adhesion and/or mechanical locking. One type of striking cap now widely used is made of foamed plastics material. It can be forced over, allowed to shrink around or moulded onto a suitable projection on the nose-end of the skirt to give a mechanical lock.

Thus in another preferred embodiment of the invention, the nose-stem of the skirt has a radial extension attached to it. This extension is preferably a disc. The disc provides the required projection from the stem for the mechanical locking with the cap.

The disc is conveniently provided as a separate moulding with a central hole to accommodate the stem and may be attached to the nose-stem by any conventional means. For example, it can be adhered or spun-welded to the stem or the end of the stem can be peened after the disc has been fitted on it. The disc must be sufficiently stiff to prevent the skirt being pulled out of the cap. However as shuttlecocks must be light, the weight of the disc can best be kept to a minimum by its having a tapered cross-section. By this means the stiffness/low weight requirement can be optimized.

Discs of different weights can be used to produce shuttlecocks having different characteristics.

A further useful advantage of the nose-stem feature of the invention is that it enables the nose-end to be set further into the striking cap than with conventional shuttlecocks without changing the basic external configuration, shape or weight of the cap.

The invention will now be further described, by way of example only, with reference to the accompanying drawings, in which.

Figure 2:
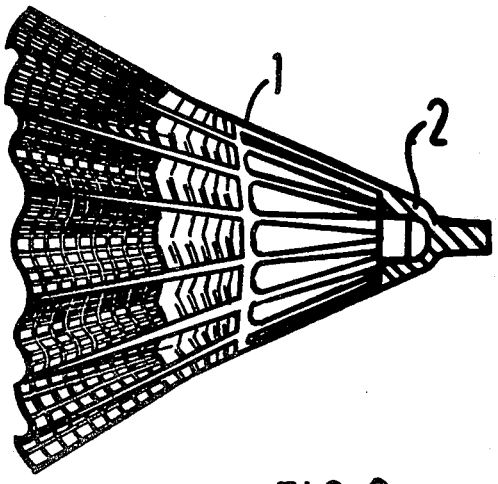
FIG. 2 is a longitudinal cross-section through a skirt according to the present invention.
Figure 4:
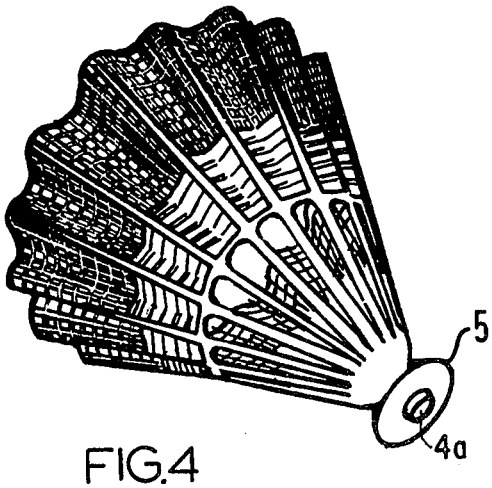
FIG. 4 is a perspective view of the shuttlecock of FIG. 2 provided with a disc for locking the cap.

The shuttlecock skirt shown in FIG. 2 has stems 1 moulded integrally with an elongated end ring 2 of generally 'U'-shaped cross-section. As can be seen from FIG. 3 the stems are attached to (integrally formed with) the end ring, along the arms 3 of the 'U'. The cylinder is provided with a nose-stem 4 to which can be attached an extension e.g. a disc 5 (FIG. 4) to engage with a cap. As previously mentioned the disc 5 is held in place by the peened end of a narrower outermost portion 4*a* of the stem 4. After the disc 5 is fitted over the portion 4*a* the end of portion 4*a* is then peened to retain the disc in position as shown in FIG. 4. A suitable cap 6 is shown in FIG. 5.

Figure 1:
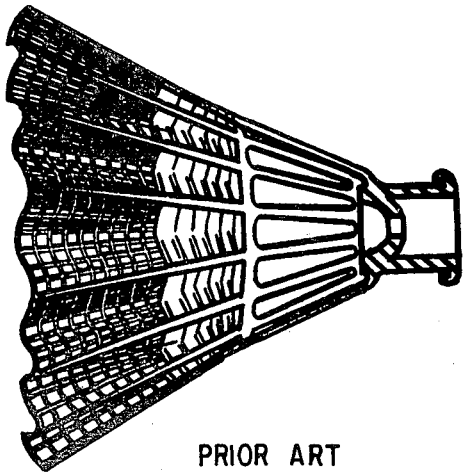
PRIOR ART FIG.1
FIG. 1 is a longitudinal cross-section through a conventional shuttlecock skirt.
Figure 5:
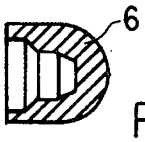
FIG. 5 is a cross-section of a suitable cap.

It will be appreciated that in comparison with the nose end of FIG. 1, the nose end of the shuttlecock of FIG. 2 can be set more deeply into the end cap shown in cross-section in FIG. 5. This can give extra protection to the stems or vanes at one of their most vulnerable points, i.e. at and just above their attachment to the end-ring. Since such points can be set inside the end cap, the effective length of the shuttlecock with the striking cap attached can be kept constant by a corresponding increase in the length of the skirt to offset the extra nose-end length enclosed in the cap.

Figure 3:
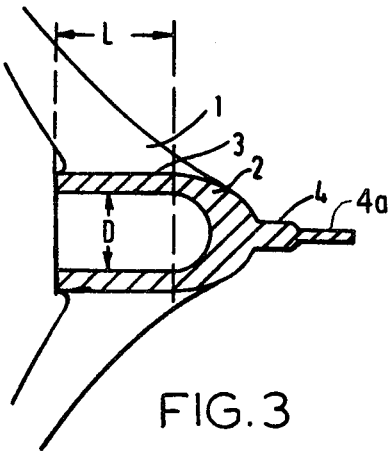
FIG. 3 is an enlarged section of the end ring of the skirt of FIG. 2.

As indicated above the shuttlecock skirts of this invention can be conveniently made by injection moulding from a suitable plastics material. Suitable materials are well known in the art. The skirt illustrated in FIG. 3 is particularly suitable for manufacture in this way. A mould having a cavity corresponding to the desired shape of the skirt can very conveniently be filled with plastics material by injection at the nose-stem end, i.e. the nose-stem corresponding to the injection inlet port of the mould.

Having described my invention — what I claim is:

1. An integrally moulded shuttlecock skirt comprising a plurality of diverging stems, said stems defining a substantially frusto-conical structure and the ends of said stems at the convergent end of the skirt being joined together to form an end-ring in the form of a hollow cylinder, said cylinder at its end remote from the stems being closed by an outwardly convex wall and said closed end having a centrally-disposed spigot of a diameter smaller than said cylinder extending in the direction away from the skirt to provide anchorage means for a striking cap.

2. A shuttlecock skirt according to claim 1, in which said end-ring cylinder has an axial length in the range 2 to 10 mm, an internal diameter in the range 4 to 12 mm and a wall thickness in the range 0.3 to 1 mm.

3. A shuttlecock skirt according to claim 1, in which said end ring cylinder has an axial length in the range 3 to 8 mm, an internal diameter in the range 6 to 9 mm and a wall thickness in the range 0.3 to 1 mm.

4. A shuttlecock skirt according to claim 1, in which a disc is secured to said spigot to provide a radial extension for anchoring a striking cap.

5. An integrally moulded shuttlecock skirt comprising a pluarlity of diverging stems, said stems defining a substantially frusto-conical structure and the ends of said stems at the convergent end of the skirt being joined together to form an end-ring in the form of a hollow cylinder, said cylinder being substantially free of radially extending projections and at its end remote from the stems being closed by an outwardly convex wall, said wall having a centrally-disposed spigot of a diameter smaller than said cylinder extending in the direction away from the skirt to provide anchorage means for a striking cap.

6. A shuttlecock comprising an integrally moulded shuttlecock skirt comprising a plurality of diverging stems, said stems defining a substantially frusto-conical structure and the ends of said stems at the convergent end of the skirt being joined together to form an end-ring in the form of a hollow cylinder, said cylinder at its end remote from the stems being closed by an outwardly convex wall and said closed end having a centrally-disposed spigot extending in the direction away from the skirt; and a striking cap anchored to said spigot.

7. A shuttlecock according to claim 6, in which said stems at their points of attachment to said end-ring are positioned within said striking cap.

* * * * *